US010279354B2

(12) United States Patent
Young et al.

(10) Patent No.: US 10,279,354 B2
(45) Date of Patent: May 7, 2019

(54) IMPACT CRUSHER AND CURTAIN ADJUSTMENT SYSTEM

(71) Applicant: McLanahan Corporation, Hollidaysburg, PA (US)

(72) Inventors: Gregory A. Young, Cedar Rapids, IA (US); Blake Pinckney, Cedar Rapids, IA (US)

(73) Assignee: McLanahan Corporation, Hollidaysburg, PA (US)

( * ) Notice: Subject to any disclaimer, the term of this patent is extended or adjusted under 35 U.S.C. 154(b) by 635 days.

(21) Appl. No.: 14/921,362

(22) Filed: Oct. 23, 2015

(65) Prior Publication Data

US 2016/0114331 A1 Apr. 28, 2016

Related U.S. Application Data

(60) Provisional application No. 62/068,327, filed on Oct. 24, 2014.

(51) Int. Cl.
*B02C 25/00* (2006.01)
*B02C 13/09* (2006.01)

(52) U.S. Cl.
CPC ..... *B02C 25/00* (2013.01); *B02C 13/09* (2013.01); *B02C 13/095* (2013.01)

(58) Field of Classification Search
CPC ..... B02C 25/00; B02C 13/09; B02C 13/095
USPC ..... 241/36–37, 286–290
See application file for complete search history.

(56) References Cited

U.S. PATENT DOCUMENTS 5,718,389 A * 2/1998 Finken ..... B02C 13/095 241/189.1
7,293,725 B2 11/2007 Moriya et al.
7,318,463 B2 * 1/2008 Tanaka ..... B02C 21/026 144/36
7,591,437 B2 * 9/2009 Nilsson ..... B02C 1/025 241/30
8,033,489 B2 10/2011 Boast
8,490,905 B2 * 7/2013 Dallimore ..... B02C 13/095 241/101.3
8,668,158 B2 * 3/2014 Dallimore ..... B02C 25/00 241/189.1

(Continued)

OTHER PUBLICATIONS

Parker Hamilton Corporation, Intellinder Absolute Position Sensor, Catalog HY18-0035/US, Nov. 2013, pp. 1-12.

*Primary Examiner* — Faye Francis
(74) *Attorney, Agent, or Firm* — The Webb Law Firm

(57) ABSTRACT

An impact crusher for crushing a feed material received through an opening of the crusher is provided. The crusher includes: a housing defining a crushing chamber; at least one elevation adjustable impact barrier mounted in the crushing chamber; a barrier adjustment mechanism configured to adjust an elevation of the at least one impact barrier within the crushing chamber; and a rotor mounted in the crushing chamber and turned by a drive mechanism. The rotor is configured to direct feed material toward the at least one impact barrier. The bather adjustment mechanism includes at least one hydraulic cylinder mounted to the at least one impact barrier. The cylinder includes a sensor for detecting an absolute extension of the cylinder. A system for crushing a crushable material including an impact crusher and controller is also provided herein.

18 Claims, 15 Drawing Sheets

(56) References Cited

U.S. PATENT DOCUMENTS

| | | | | |
|---|---|---|---|---|
| 8,844,851 | B2 * | 9/2014 | Solomon | B02C 13/095 241/189.1 |
| 8,967,504 | B2 * | 3/2015 | Dallimore | B02C 25/00 241/27 |
| 2011/0253821 | A1 * | 10/2011 | Dallimore | B02C 13/095 241/189.1 |
| 2011/0253822 | A1 * | 10/2011 | Dallimore | B02C 25/00 241/189.1 |
| 2013/0146692 | A1 * | 6/2013 | Dallimore | B02C 25/00 241/27 |
| 2014/0151482 | A1 * | 6/2014 | Solomon | B02C 13/095 241/286 |
| 2016/0114331 | A1 * | 4/2016 | Young | B02C 13/095 241/37 |
| 2016/0250642 | A1 * | 9/2016 | Lindstrom | B02C 1/02 241/25 |

* cited by examiner

IMPACT CRUSHER AND CURTAIN ADJUSTMENT SYSTEM

CROSS REFERENCE TO RELATED APPLICATION

This application claims priority to U.S. Provisional Patent Application No. 62/068,327 filed on Oct. 24, 2014, the disclosure of which is hereby incorporated by reference in its entirety.

BACKGROUND OF THE INVENTION

Field of the Invention

The present invention relates to crushing machinery and, specifically, to an impact crusher and curtain adjustment system for manually or automatically adjusting crusher settings to control product size produced by the crusher.

Description of Related Art

Crushing machinery is used to reduce large rocks, concrete, asphalt, and the like into smaller rocks, gravel, or rock dust for use in construction and building industries. Hard rock generally refers to rock materials that are hard, tough, abrasive, and have low friability, such as materials produced from shot rock or gravel quarries. As such, the crushing machinery is often provided in remote locations, such as quarries or construction sites.

One type of crushing machinery well-suited for reducing the size of hard materials is an impact crusher, such as an Andreas-style crusher, New Holland-style crusher, or Hammer Mill-style crusher. Impact crushers have been known for many years and are commercially available from a number of manufacturers including the Assignee of the present application, McLanahan Corporation of Hollidaysburg, Pa. An impact crusher includes a body or housing defining a crushing chamber and having a rotor mounted therein. The rotor is configured to strike feed material, such as rocks or other hard materials that enter the crushing chamber through a feed opening of the housing. The rotor includes a plurality of arms, referred to as hammers or blow bars, extending radially therefrom, which serve as the primary impact devices for breaking down feed material in the crushing chamber. A body, referred to as a curtain, anvil, apron, or breaker plate having an impact surface against which material present in the crushing chamber can be directed during operation of the crusher, extends into the crushing chamber a predetermined and adjustable distance. The impact surface of the body can be angled toward the swept area or hammer circle defined by the blow bars or hammers. The distance between the curtain and swept area or hammer circle determines the maximum grade of material that can pass through the crushing chamber. Exemplary impact crushers are disclosed in U.S. Pat. No. 7,293,725 to Moriya et al. and U.S. Pat. No. 8,033,489 to Boast.

Known impact crushers can include a number of different types of mechanisms, such as hydraulic jacks, mechanical shims, and locking mechanisms, for adjusting the position and orientation of the curtains or aprons. In most cases, the mechanisms are configured to adjust the curtain or apron position when the rotor is stationary and when the main crusher drive mechanism is powered down. Accordingly, curtain position is usually adjusted prior to beginning a crushing operation. Many known crushers also do not include monitoring or operating systems that are capable of monitoring operation of the crusher and making adjustments necessitated by wear to crusher components while the apparatus is in use.

For these reasons, new systems for adjusting operating settings and monitoring operation of impact crushers are needed. More specifically, there is a need for an improved adjusting system that is capable of determining the position of the curtain or apron and, when necessary, adjusting the position of the curtain or apron to change the product size produced or to reduce wear to crushing components. The impact crusher and adjusting system described herein are intended to address these issues.

SUMMARY OF THE INVENTION

Preferred and non-limiting aspects or embodiments of the present invention will now be described in the following numbered clauses:

Clause 1: An impact crusher for crushing a feed material received through an opening of the crusher includes: a housing defining a crushing chamber; at least one elevation adjustable impact barrier mounted in the crushing chamber; a barrier adjustment mechanism configured to adjust an elevation of the at least one impact barrier within the crushing chamber; and a rotor mounted in the crushing chamber and turned by a drive mechanism. The rotor is configured to direct feed material toward the at least one impact barrier. The bather adjustment mechanism includes at least one hydraulic cylinder mounted to the at least one impact barrier. The cylinder includes a sensor for detecting an absolute extension of the cylinder.

Clause 2: The impact crusher of clause 1, wherein a shortest distance between the rotor and an impact surface of one of the at least one barrier defines a gap setting of the crusher, and wherein adjustment of the elevation of the at least one barrier can increase or decrease the gap setting.

Clause 3: The impact crusher of clause 1, wherein the drive mechanism can be configured to turn the rotor at a rotation rate of at least about 400 rpm.

Clause 4: The impact crusher of clause 1, wherein the hydraulic cylinder can include a retractable member having a plurality of graduated markings thereon. The sensor can be configured to detect the plurality of markings to identify the absolute extension of the cylinder.

Clause 5: The impact crusher of clause 4, wherein the sensor can include an optical sensor.

Clause 6: The impact crusher of clause 1, wherein the at least one impact barrier can include a first impact barrier and a second impact barrier. The elevation of each barrier can be independently controlled by a respective hydraulic cylinder.

Clause 7: The impact crusher of clause 1, wherein the at least one hydraulic cylinder can be configured to float relative to the housing of the crusher, such that the elevation of the at least one impact barrier is movable without adjustment of the extension of the at least one hydraulic cylinder.

Clause 8: The impact crusher of clause 1, wherein the barrier adjustment mechanism can include at least one shock absorber mounted between the at least one, hydraulic cylinder and the housing. The shock absorber can be configured to at least partially absorb impact forces between the at least one hydraulic cylinder and the crusher housing.

Clause 9: The impact crusher of clause 7, wherein the barrier adjustment mechanism can include a mechanical stop mechanism configured to block the at least one impact barrier from being lowered below a predetermined minimum elevation.

Clause 10: The impact crusher of clause 1, also including an auxiliary drive that can be configured to selectively engage the rotor and to turn the rotor at a low rotation rate.

Clause 11: The impact crusher of clause 10, wherein the auxiliary drive mechanism can include a wheel configured to engage a rotary belt of the drive mechanism by a friction engagement to advance the rotary belt.

Clause 12: The impact crusher of clause 11, wherein the wheel can be mounted to an elevation adjustable lever mounted to a mechanical actuator, and wherein adjustment of extension of the mechanical actuator can cause the wheel to engage or disengage from the belt.

Clause 13: The impact crusher of clause 12, wherein the mechanical actuator of the auxiliary drive can include at least one sensor for determining an amount of pressure exerted between the rotary belt and the wheel.

Clause 14: A system for crushing a crushable material includes an impact crusher and a controller. The an impact crusher includes: a housing defining a crushing chamber; at least one elevation adjustable impact barrier mounted in the crushing chamber; a barrier adjustment mechanism configured to adjust an elevation of the at least one impact barrier within the crushing chamber; and a rotor mounted in the crushing chamber and turned by a drive mechanism. The rotor is configured to direct feed material toward the at least one impact barrier. The barrier adjustment mechanism includes at least one hydraulic cylinder mounted to the at least one impact barrier. The cylinder includes a sensor for detecting an absolute extension amount for the cylinder. The controller is configured to: receive a zero setting of the impact crusher; receive a gap setting selection for the crusher; calculate, based on the received zero setting, a cylinder position required for the at least one hydraulic cylinder to achieve the selected gap setting; and one of extend and retract the hydraulic cylinder to the calculated cylinder position based on information from the sensor associated with the hydraulic cylinder.

Clause 15: The system of clause 14, wherein the impact crusher can further include an auxiliary drive configured to selectively engage the rotor and to turn the rotor at a low rotation rate, the auxiliary drive including a wheel configured to engage a rotary belt of the drive mechanism by a friction engagement to advance the rotary belt.

Clause 16: The system of clause 15, wherein receiving the zero setting can include the following: causing the auxiliary drive to engage the rotor and to rotate the rotor at a low rotation rate; extending the at least one hydraulic cylinders thereby causing the at least one impact barrier to be lowered toward the rotor; and identifying an extension position of the hydraulic cylinder when contact between the at least one impact barrier and the rotor occurs.

Clause 17: The system of clause 16, further including an audio sensor associated with the rotor, and wherein identifying contact between the rotor and impact barrier comprises identifying, with the audio sensor, a sound representative of contact between the impact barrier and the rotor.

Clause 18: The system of clause 14, wherein the controller can be configured to cause the barrier adjustment mechanism to adjust an elevation of a second impact barrier based on a selected or predetermined ratio between the selected gap setting and a gap setting for the second impact barrier.

Clause 19: The system of clause 14, wherein the controller can be configured to determine a wear level of one of the rotor and/or the at least one impact barrier, the wear level being determined based on a difference between a factory zero setting and the received zero setting.

Clause 20: A non-transitory computer readable medium includes program instructions that when executed by at least one controller in communication with an impact crusher cause the controller to: receive a zero setting of the impact crusher; receive a gap setting selection for the crusher; calculate, based on the received zero setting, a cylinder position required for at least one hydraulic cylinder mounted to an impact barrier disposed in a crushing chamber of the impact crusher, to achieve the selected gap setting; and one of extend and retract the at least one hydraulic cylinder to the calculated cylinder position based on information from an absolute position sensor associated with the at least one hydraulic cylinder.

BRIEF DESCRIPTION OF THE DRAWINGS

Some of the advantages and features of the preferred embodiments of the invention have been summarized hereinabove. These embodiments, along with other potential embodiments of the device, will become apparent to those skilled in the art when referencing the following drawings in conjunction with the detailed descriptions as they relate to the figures.

DESCRIPTION OF THE INVENTION

Figure 1:
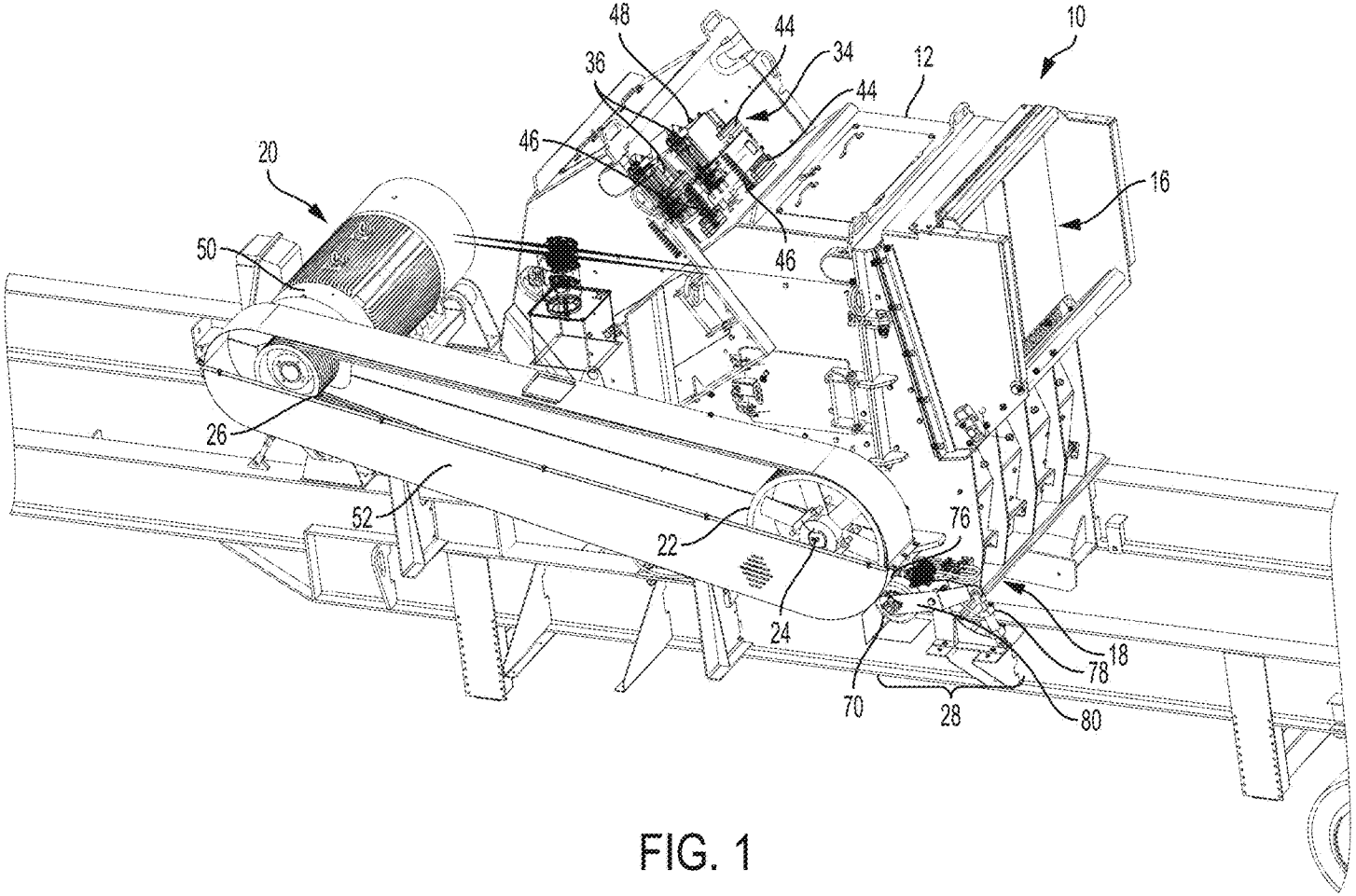
FIG. 1 is a perspective view of an impact crusher according to an aspect of the present disclosure.

The drawings generally show preferred embodiments of an impact crusher and curtain adjustment system. While the descriptions present various examples of the impact crusher, it should not be interpreted in any way as limiting the invention. Furthermore, modifications, concepts, and applications of the embodiments of the invention are to be interpreted by those skilled in the art as being encompassed, but not limited to, the illustrations and descriptions herein. Additionally, the following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "end," "upper," "lower," "right," "left," "vertical," "horizontal," "top," "bottom," "lateral," "longitudinal," and derivatives thereof, shall relate to the invention as it is oriented in the drawing figures. The terms "inner" or "inward" refer to a direction toward a center of the apparatus or device. "Outer" or "outward" refers to a direction away from a center and toward an exterior of the apparatus or device. However, it is to be understood that the invention may assume various alternative variations and step sequences, except where expressly specified to the contrary. It is also to be understood that the specific devices and processes illustrated in the attached drawings and described in the following specification are simply exemplary embodiments of the invention. Hence, specific dimensions and other physical characteristics related to the embodiments disclosed herein are not to be considered as limiting. For the purpose of facilitating an understanding of the invention, the accompanying drawings and descriptions illustrate preferred embodiments thereof, from which the invention, various embodiments of its structures, construction and method of operation, and many advantages may be understood and appreciated.

As used herein, the terms "communication" and "communicate" refer to the receipt or transfer of one or more signals, messages, commands, or other types of data. For one unit or component to be in communication with another unit or component means that the one unit or component is able to directly or indirectly receive data from and/or transmit data to the other unit or component. This can refer to a direct or indirect connection that can be wired and/or wireless in nature. Additionally, two units or components can be in communication with each other even though the data transmitted can be modified, processed, routed, and the like, between the first and second unit or component. For example, a first unit can be in communication with a second unit even though the first unit passively receives data\ and does not actively transmit data to the second unit. As another example, a first unit can be in communication with a second unit if an intermediary unit processes data from one unit and transmits processed data to the second unit. It will be appreciated that numerous other arrangements are possible.

The present application is generally directed to an impact crusher and control system for automatically calibrating and positioning crusher components while the rotor is in motion and without needing to stop operation of the drive motor (referred to hereinafter as the main motor). To achieve this function, crusher components are mounted to and controlled by automated hydraulic cylinders including sensors for accurately determining and providing feedback about absolute cylinder position and/or about an absolute extension distance of the cylinder piston. Beneficially, the crusher and controller are capable of dynamic determination of a zero position between the crusher curtain and rotor when the rotor is in motion. The dynamic position feedback information can be used to automatically adjust crusher settings without delays required to turn off the main motor and stop rotation of the rotor as is required for currently available crushing machinery. In addition, the presently invented crusher and system include a user interface for assisting a system operator to monitor and compensate for wear of crusher components following prolonged use. The user interface can also be used to provide notifications regarding when crusher components should be replaced as a result of accumulated wear.

Exemplary Impact Crusher:

With reference to FIGS. 1-6, an impact crusher 10 is illustrated that is capable of crushing feed material, such as large rocks, stones, and similar hard materials into gravel, smaller rocks, or rock dust. The impact crusher 10 illustrated in FIGS. 1-6 is referred to as an Andreas-style crusher. An exemplary Andreas-style crusher, that can be modified to include the hydraulic cylinders and control system disclosed in the present application, is the Model 5160 Primary Impact Crusher manufactured by McLanahan Corporation. Other types of crushers that can be modified to include the hydraulic cylinders and control systems described herein include, for example, New Holland-style crushers and Hammer Mill-style crushers. The impact crusher 10 includes a housing 12 that encloses a crushing chamber 14 (shown in FIG. 2). The crusher 10 is configured such that feed material enters the crushing chamber 14 through a feed opening 16 located near the top portion of the housing 12. The crushed material is expelled from the crushing chamber 14 via a discharge outlet 18 located near the bottom portion of the housing 12.

With specific reference to FIG. 1, in some examples, the crusher 10 includes a drive mechanism 20 including a flywheel 22 configured to drive a shaft or rotor 24 extending through a side of the housing 12. The flywheel 22 is connected to a drive motor, such as a main motor 50, by a belt 26, such as a rotary belt and/or v-belt 26. The main motor 50 can be a hydraulic motor, internal combustion (e.g., gasoline or diesel powered) motor, and/or an electric motor. The rotor 24 spins freely within the crushing chamber 14 driving feed material (e.g., hard rocks to be crushed) entering the chamber 14 against the aprons or curtains and/or walls of the chamber 14 thereby crushing the feed material. In normal operation, the rotation rate of the rotor 24 is at least 400 rpm, and preferably about 500 rpm.

In some examples, the impact crusher 10 can also include an auxiliary mechanism for advancing the flywheel 22, referred to herein as a low-rotation drive mechanism 28. The low-rotation drive mechanism 28 comprises a drive wheel 70, such as a rubberized disk or foam-filled tire, which is driven by a hydraulic motor 72 (shown in FIG. 6), that temporarily engages the flywheel 22 to cause low speed rotation of the flywheel 22. Low speed rotation is used to establish calibration settings for the crusher 10. Once the calibration settings are determined, the wheel can be disengaged and the rotor 24 can be turned at normal operated speeds (e.g., about 500 rpm) by the main motor 50. The low-rotation rate drive mechanism 28 is configured to rotate the flywheel 22 and rotor 24 at a rotation rate of about 20 rpm to 30 rpm.

Figure 2:
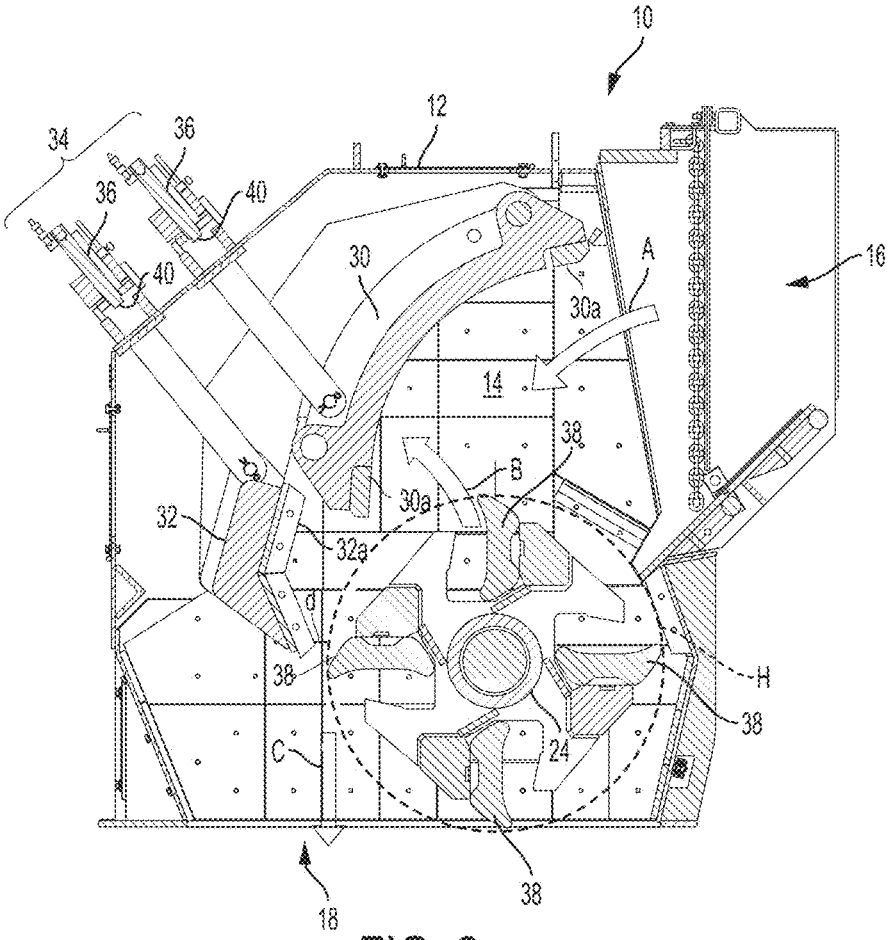
FIG. 2 is a cross section view of the impact crusher of FIG. 1.

Crushing Chamber:

With specific reference to FIG. 2, a cross section view of the crushing chamber 14 is illustrated. The crushing chamber 14 includes one or more aprons or curtains, such as a primary or upper curtain 30 and a secondary or lower curtain 32, extending into the chamber 14. While the crushing chamber 14 illustrated in FIG. 2 includes two curtains, crushers 10 having any number of curtains can be used with the systems and methods of the present disclosure. For example, a crusher can include only a single curtain. Other crushers can include three or more curtains. In some examples, each curtain 30, 32 can define a stage or chamber for the crushing process. For example, crushable material can be crushed by the upper curtain 30 until it is reduced to a predetermined size or size range. At that point, the material passes to a second crushing stage or crushing chamber defined by the lower curtain 32. In the second stage or chamber, the material is reduced further until it is a suitable size or range of sizes that can be expelled from the crusher 10. In some examples, the curtains 30, 32 are held in place by a curtain adjusting mechanism 34, including one or more hydraulic rams or cylinders 36. For example, one end of each curtain 30, 32 can be pivotally connected to the housing 12, and the other end of each curtain 30, 32 can be mounted to one of the cylinders 36, such that as the cylinder 36 extends or retracts, the curtain 30, 32 is rotated about the connection with the housing 12. In some examples, each curtain can include liners, often referred to as a wear plate 30*a*, 32*a*, mounted to impact or inner surfaces thereof. The wear plates 30*a*, 32*a* are removable and replaceable, thereby extending the useful life of the curtain 30, 32.

The shaft or rotor 24 extends through the crushing chamber 14 and includes a plurality of hammers 38 extending radially from the shaft 24. The hammers 38 are shaped and positioned to drive the feed material against the curtains 30, 32 for crushing. The outer circumference of the hammers 38 forms a circle H, often referred to as the "hammer circle" or "swept area". A distance d between the nearest edge of the lower curtain 32 and the circle H defines the gap setting for the crusher 10. The gap setting or distance d defines an average or general size of material that is produced by the crusher 10 at a given operational setting. In most cases, the gap setting is not an absolute size of crushed material. Instead, in normal operation, it can be assumed that about 80 percent of material passing from the crusher will have a diameter smaller than the gap setting distance d. For calibration purposes, a zero setting is referred to as the position in which the lower edge of the lower curtain 32 just contacts the circle H (e.g., d=0). Further, while the zero setting is described here for the lower curtain, it could additionally apply to other curtains as well.

The feed material enters the crushing chamber 14 through the opening 16. For example, the feed material can enter the crushing chamber 14 at about a 45 degree angle. In the crushing chamber 14, feed material is crushed by one or more of the following mechanisms: (1) impact between the feed material and the hammers 38; (2) impact between the feed material and the curtains 30, 32; and (3) impact from feed material (e.g. rocks or gravel) traveling in one direction striking feed material traveling in another direction. More specifically, as shown by arrow A, the feed material falls by gravity toward the rotor 24 and hammers 38. Some material is crushed as a result of contact with the hammers 38. As shown by arrow B, the hammers 38 drive or direct the feed material toward the upper curtain 30. Upon contacting the upper wear plate 30*a*, additional crushing of the feed material occurs. Once the material is reduced to a specific size, it can pass to a second crushing stage or crushing chamber defined by the lower curtain 32 in which additional crushing occurs. Alternatively, crushed material is directed back towards the rotor 24 and hammers 38 to repeat the crushing process. While being directed back toward the hammers 38, the material can impact other rocks being driven in another direction and causing additional crushing to occur. After crushing, the crushed feed material is guided or expelled from the chamber 14 by the hammers 38 through the discharge outlet 18, as shown by arrow C. In this way, feed material is introduced to the crushing chamber 14 at the opening 16, repeatedly contacts the hammers 38 and curtains 30, 32 until it is reduced to a desired size corresponding to the gap setting or distance d, and then is expelled by from the discharge outlet 18 at a lower portion of the crushing chamber 14.

Curtain Adjustment Mechanism:

Having generally described the structure and operation of the impact crusher 10, the mechanism for adjusting the position of the curtain in accordance with the present invention, and with reference to FIGS. 1-4, will now be discussed in detail. The curtain adjusting mechanism 34 includes structures for repositioning the curtains 30, 32 to a desired distance from the swept area of the rotor 24 defined by circle H. Generally, the curtain adjustment mechanism 34 includes the hydraulic cylinders 36. As shown, for example, in FIG. 2, each curtain 30, 32 can be mounted to and controlled by its own hydraulic cylinder 36, although examples including multiple curtains controlled and positioned by a single hydraulic ram can be envisioned within the scope of the present disclosure. Similarly, in some examples, multiple cylinders 36 can be used to position and support one curtain. The crusher 10 illustrated in FIG. 2, includes two curtains 30, 32 and, accordingly, includes two independent hydraulic cylinders 36.

Figure 3:
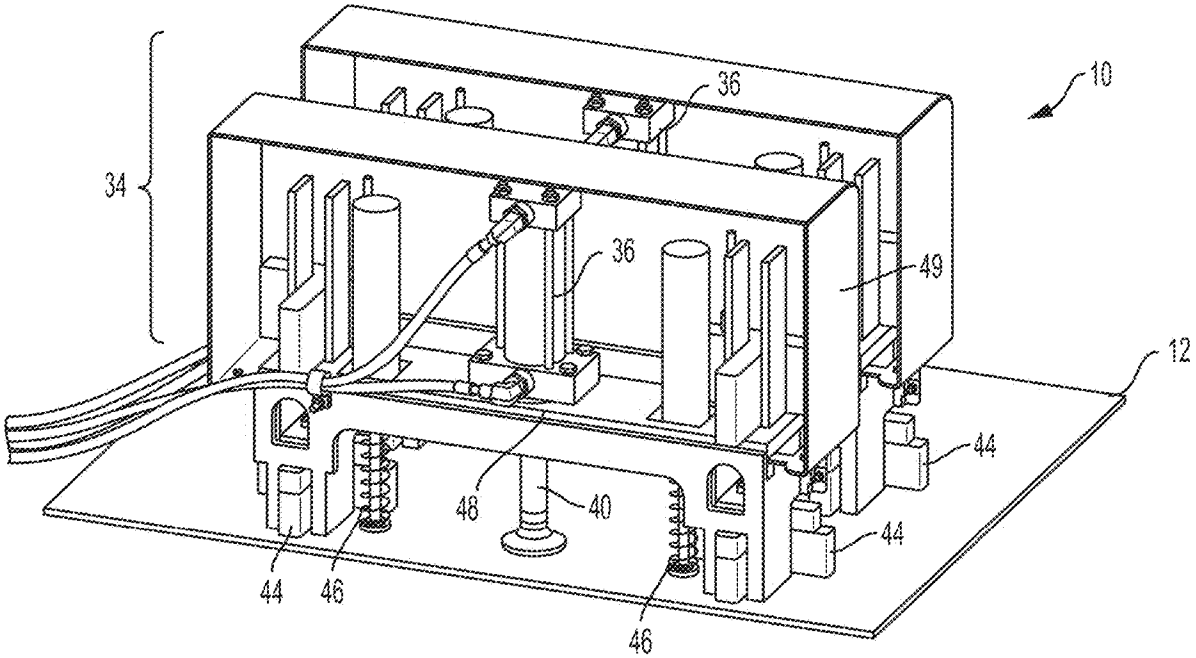
FIG. 3 is a perspective view of a curtain adjustment mechanism of the impact crusher of FIG. 1.
Figure 4:
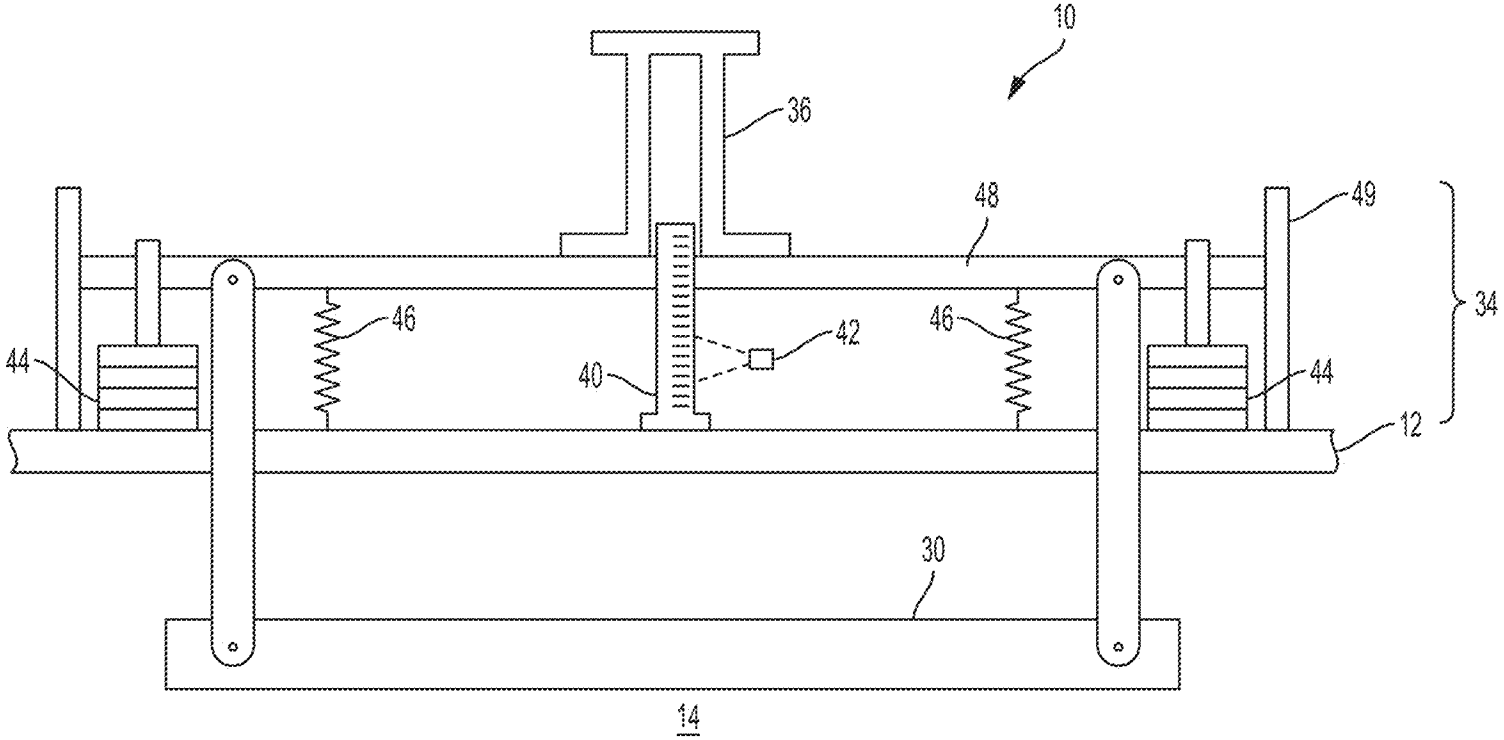
FIG. 4 is a schematic drawing of the curtain adjustment mechanism illustrated in FIG. 3.

In some examples, one or more of the hydraulic cylinders are mounted between the housing 12 of the crusher 10 and a movable horizontal member, referred to herein as a bridge 48. For example, as shown in FIGS. 3 and 4, each bridge 48 is independently moved by one hydraulic cylinder 36. The curtain adjusting mechanism 34 can also include additional structural elements for supporting the cylinders 36 and/or bridge, including a frame 49, mechanical shims 44, and shock absorbers, such as helical springs 46. As shown, for example, in FIG. 4, each end of the bridge 48, is connected to a vertical support or rod. The vertical support is connected to a portion of the curtain 30 for positioning the curtain in the crushing chamber 14. In this arrangement, extending the hydraulic cylinder 36 drives the bridge 48 away from the housing 12, thereby lifting the curtain 30. Conversely, retracting the hydraulic cylinder 36 moves the bridge toward the housing 12, thereby lowering the curtain 30.

In some examples, the bridge 48 and cylinders 36 connected thereto are arranged to float relative to the housing 12. In this way, the curtains 30, 32 can lift to allow uncrushable materials (e.g., metal deposits, pieces of metal from other equipment such as drills, trucks, loaders/shovels, or bulldozers) to be expelled from the crusher 10 without damaging the curtains 30, 32, rotor 24, and/or hammers 38. Specifically, when uncrushable material is encountered, bridge 48 is moved away from the housing 12, thereby temporarily opening or increasing the gap setting (distance d in FIG. 2) by allowing the curtains 30, 32 to pivot away from the rotor 24 and hammer circle H. Once the curtain 30, 32 is lifted the uncrushable material can pass through the crusher 10 without needing to adjust the position or extension of the cylinders 36. Once the uncrushable material passes through the crusher 10, the bridge 48 returns to its original position supported by the cylinder 36, thereby lowering the curtains 30, 32 to their previous or operating position. Beneficially, the settings (e.g., the gap setting and/or zero position) for the crusher 10 do not need to be reset or recalibrated either to permit the uncrushable material to pass through the crusher 10 or to reset the curtains 30, 32 after passing of the uncrushable material. Accordingly, the crusher 10 is able to return to normal operation with minimal delay.

In some examples, one or more of the hydraulic cylinders 36 include features for automatically determining the absolute cylinder position (e.g., the absolute distance that the cylinder piston extends from a cylinder body or base). The position of the curtains 30, 32 can be calculated based on the absolute position or extension measured by the cylinders 36. In some examples, one or more of the curtain hydraulic cylinders 36 are the Intellinder™ cylinder manufactured by Parker Hannifin Corporation of Elk Grove Village, Ill. With specific reference to FIG. 4, the Intellinder™ cylinder includes a retractable member, such as a piston 40, having markers or indicia etched or printed thereon that can be read by a sensor 42, such as an optical or contact sensor, placed adjacent to the piston 40. In some embodiments, the piston 40 can be actuated directly by the hydraulic cylinder 36. In other examples, the piston 40 can be a secondary member connected to and driven by a piston of the hydraulic cylinder 36. The markers can comprise a series of grooves or other indicators arranged to convey information about the absolute position of the piston 40. For example, the grooves or etchings can be arranged to form a bar code or QR code capable of being identified by an optical sensor, such as a barcode scanner, infrared detector, or camera. As the piston 40 is retracted or extended from the hydraulic cylinder 36, the grooves pass within a line-of-sight of the sensor 42. The sensor 42 collects information representative of the position and/or arrangement of the markers on the piston 40. The collected information can be used to automatically identify the absolute position of the piston 40 and, accordingly, the cylinder position. The sensor 42 can be electrically coupled to a controller or system, such a programmable logic controller (PLC) for coordinating adjustment of the curtains with other mechanical functions of the impact crusher 10.

With reference to FIGS. 3 and 4, the curtain adjusting mechanism 34 can also include mechanical locking or positioning elements, such as shims 44. The mechanical locking or positioning element can also be a threaded rod, mechanical stop, mechanical actuator, or similar element for preventing or blocking movement of the bridge 48. The shims 44, which are shown in a storage position in FIG. 3, can be used to manually adjust the curtain position without engaging the curtain hydraulic cylinder 36. In addition, the mechanical shims 44 can be a mechanical backup or failsafe mechanism that maintains a current curtain position or, in other cases, prevents the curtains 30, 32 from lowering beyond a predetermined stop point if one or more of the hydraulic cylinders 36 lose power or fail.

The curtain adjustment mechanism 34 also includes shock absorbers, such as helical springs 46, mounted between the bridge 48 and the housing 12. In other examples, the shock absorbers can be one or more of a dashpot, mechanical dampener, or hydraulic cylinder. The springs 46 are configured to absorb or dampen impact forces on the cylinders 36 caused when the curtains 30, 32 return to their pre-set position after uncrushable material passes through the chamber 14. Specifically, the springs 46 can be configured to protect the bridge 48 and cylinders 36 from shock loads developed when the curtains 30, 32 pass an uncrushable item and drop back into their pre-set positions. Additionally, since the bridge 48 floats freely relative to the housing 12, it can be moved away from the housing 12 without needing to reset the hydraulic cylinders 36. The springs 46 are positioned to absorb force between the curtains 30, 32 and housing 12 so that the curtains 30, 32, bridge 48, and cylinders 36 are not damaged when this movement occurs. Once the uncrushable material passes through the chamber 14, the bridge 48 and springs 46 return to their original (e.g., pre-set) position, in which the curtains 30, 32 are supported by the cylinders 36.

Figure 5:
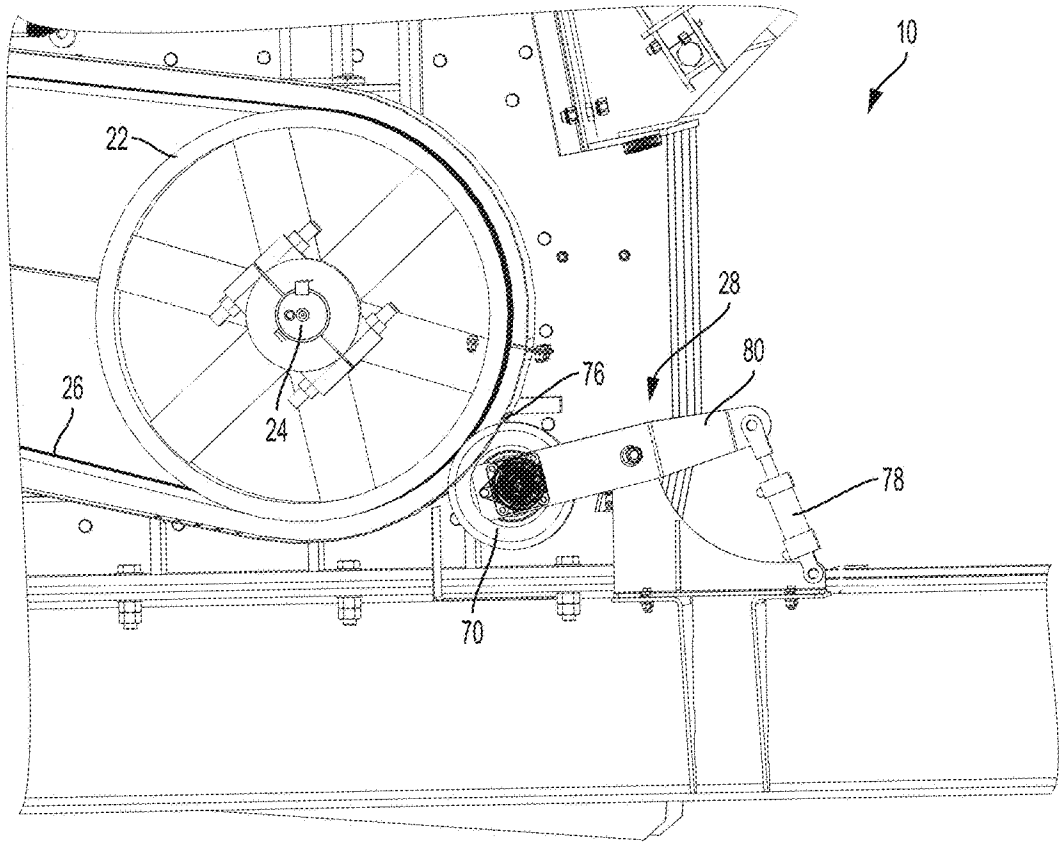
FIG. 5 is a perspective view of the low-rotation drive mechanism of the impact crusher of FIG. 1.

Low-Rotation Drive Mechanism:

Having described the crusher 10 and curtain adjust mechanism 34, with reference to FIGS. 1, 5, and 6, the structure and function of the low-rotation drive mechanism 28 will be discussed in detail. The low-rotation drive mechanism 28 comprises the drive wheel 70 and hydraulic motor 72 (shown in FIG. 6). The hydraulic motor 72 is separate and independent from the main motor 50 that rotates the flywheel 22 during normal operation of the crusher 10. The wheel 70 can be connected to and driven by the motor 72 by a shaft or coupling mechanism 74. The wheel 70 is transitionable from an engaged position (as shown in FIGS. 1 and 5) and a disengaged position. In the engaged position, the wheel 70 is configured to contact a portion of the v-belt 26 (e.g., the back side of the belt 26), and to drive the v-belt 26 by a frictional engagement therewith. As partially shown in FIG. 1, the belts 26 can be enclosed in a housing 52 and accessible through an access hole 76. The low-rotation drive mechanism 34 is a supplement to the drive mechanism 20 (shown in FIG. 1) and is used to rotate the rotor 24 at a low rotation rate while zeroing or calibrating the crusher 10.

The position or elevation of the wheel 70 relative to the v-belt 26 is controlled by a mechanical actuator, such as a hydraulic cylinder, referred to hereinafter as an engagement cylinder 78. The engagement cylinder 78 is connected to the wheel 70 by a shaft or lever 80. The shaft or lever 80 can be mounted to the housing 12 or to another external frame or structure adjacent to the crusher 10. Advancement or retraction of the cylinder 78 adjusts the elevation of the wheel 70, thereby causing the wheel 70 to transition between the engaged and disengaged positions.

The low-rotation drive mechanism 28 is configured only to engage the v-belt 26 to rotate the flywheel 22 at a low rotation rate. In a preferred and non-limiting example, the rotation rate for the low rotation drive mechanism 28 is less than about 20 to 25 rpm; however, the low-rotation drive mechanism 28 can be configured to operate at a variety of speeds up to 50 rpm or more. If the rotor 24 is spinning at a rotation rate that is greater than the preferred rotation rate, the crusher 10, or a controller associated therewith, can be configured to prevent the wheel 70 from coming into contact with and/or engaging the belt 26. For example, for a crusher 10 configured to operate at about 20 rpm to 25 rpm, the lockout or maximum rotor 24 rotation rate can be about 30 rpm. Limiting maximum rotation rate (e.g., ensuring that the flywheel 22 has slowed down enough before allowing the wheel 70 to engage the belts 26) reduces wear on the system and prevents damage to the rotor 24, belts 26, and/or motor 72.

Figure 6:
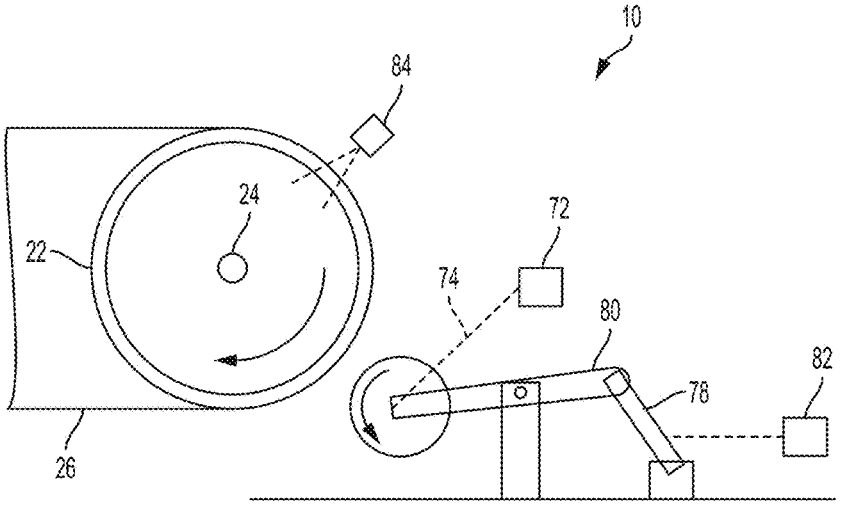
FIG. 6 is a schematic drawing of the low-rotation drive mechanism of FIG. 5.

In some examples, as shown in FIG. 6, the engagement cylinder 78 includes a sensor 82, such as a pressure sensor, contact sensor, or proximity sensor for assessing the force exerted on the wheel 70 by the belts 26 and/or flywheel 22. A signal received from the pressure sensor 82 can be used to control operation of the hydraulic motor 72 by actuating the motor when contact between the wheel 70 and belt 26 is identified and by preventing the motor 72 from operating when there is not sufficient contact between the wheel 70 and belts 26. For example, a controller can be configured to receive information from the pressure sensor 82 and can begin rotation once the measured pressure reaches a predetermined threshold value.

In some examples, the low-rotation drive mechanism 28 can also include an additional sensor, such as a rotation sensor 84, for directly sensing the rotation rate of the flywheel 22 and/or rotor 24. For example, the rotation sensor 84 can be a proximity sensor configured to identify rotation of a notch or sensing plate coupled to the rotor 24. The sensor 84 sends a signal to the crusher 10 and/or controller each time that the notch or other indicia passes through the field of view of the sensor 84, indicating that the rotor 24 has completed a rotation.

Exemplary Impact Crushing System:

Having described the crusher 10, with reference to FIG. 7, a system 100 for operating the crusher 10, curtain adjustment mechanism 34, and auxiliary drive mechanism 20 will now be discussed in detail. The system 100 includes the impact crusher 10 including the curtain adjusting mechanism 34 and low-rotation drive mechanism 28. The crusher 10 is configured to be in communication with an electronic control device 120 including a processor or controller 110. In some examples, the electronic device 120 can be a smartphone, tablet, desktop computer, and/or laptop computer. The electronic device 120 can also be a dedicated electronic device either integral with the crusher 10 or remote from the crusher 10 and configured to send and receive information therefrom. The controller 110 can be in communication with transitory or non-transitory computer readable memory having programming instructions for controlling operation of the crusher 10 and, in particular, for operating the low-rotation drive mechanism 28 and curtain adjustment mechanisms 34 to perform processing routines to determine calibration values and to adjust or modify crusher settings. For example, the controller 110 can be configured to receive information from sensors associated with the hydraulic cylinders 36 of the curtain adjustment mechanism 34 and to process the received information to determine an absolute position or extension of the cylinder piston. Based on the absolute extension of the cylinder, the controller 110 can determine the position of the curtains and, in some cases, the gap setting (e.g., the shortest distance between the curtain and the hammer circle). The controller 110 can also be configured to receive information from sensors associated with the low-rotation drive mechanism 28. Based on the received information, the controller 110 can be configured to control operation of the crusher 10 and/or to perform routines for establishing and/or calculating a zero setting for the crusher 10.

Figure 7:
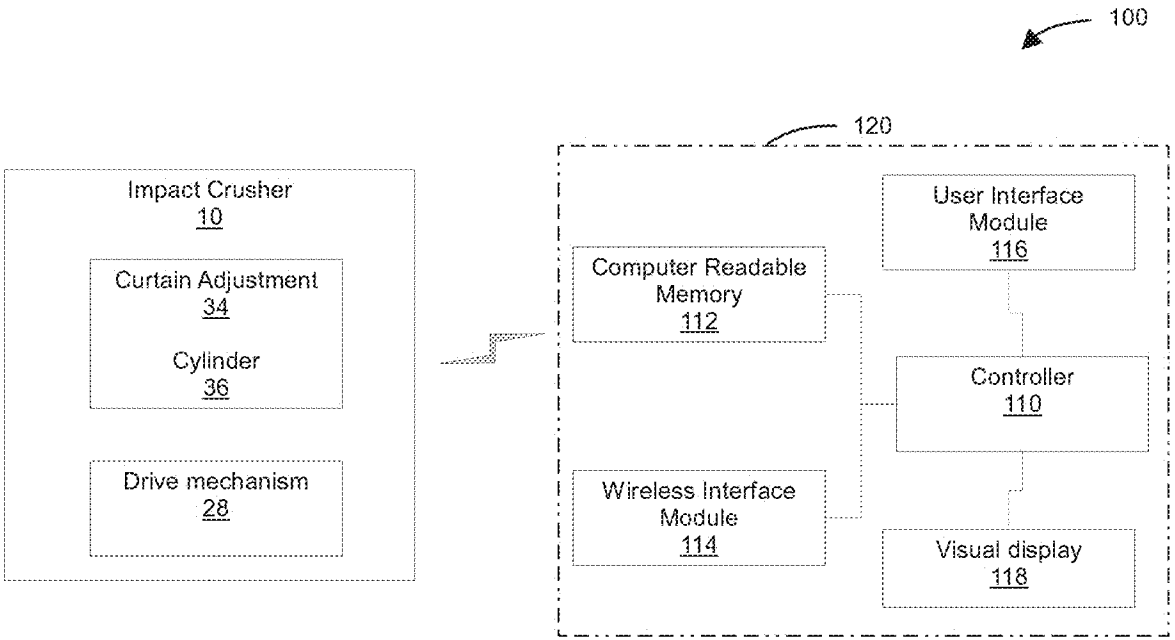
FIG. 7 is a schematic drawing of a system for curtain adjustment for the impact crusher of FIG. 1, in accordance with an aspect of the invention.

With continued reference to FIG. 7, the controller 110 can be any type of processor, microprocessor, programmable logic controller, or dedicated electronic device capable of receiving and processing data based on instructions stored either on the controller 110 or on transitory or non-transitory computer readable memory 112 in communication with the controller 110. The electronic device 120 and controller 110 can be located on the crusher 10 or can be remote from the crusher 10 and configured to receive information from the crusher 10 via a wired or wireless interface module 114. Similarly, the electronic device 120 and/or controller 110 can be configured to provide operating instructions to the crusher 10 by the wired or wireless interface module 114. For example, the interface module 114 can include a wired connection or port, using, e.g., USB, Ethernet, and FireWire protocols. In other examples, a wireless interface module 114 can be in communication with a wireless network employing a wireless network technology, such as Bluetooth, WiFi, Z-Wave, and ZigBee. WiFi (e.g., IEEE 802.11a, b, g, n) networking protocols can also be used, which advantageously have a greater transmission range than a short range transmission network, such as Bluetooth, but consequently also have greater power consumption. Suitable external sources for receiving data transmitted from the interface module 114 and optionally providing additional processing for the received data include a computer, tablet PC, or another smart phone and/or an external hard drive, or other device for backing up stored data. In addition, data can be received by a remote computer network or storage device for storage and/or for further processing and analysis.

In some examples, the electronic device 120 can also include a user interface module 116 that allows a system operator to control the crusher 10 and, in particular, to activate processing routines configured to determine the zero setting and/or to adjust the curtain position of the crusher 10. As will be discussed hereinafter in connection with FIGS. 10A-10G, the user interface module 116 can include a series of screens or menus presented to the operator on a visual display 118, such as a touch screen display. The screens or menus can include information about current crusher settings and/or measured values (e.g., pressure value for the engagement cylinder 78 or rotation rate of the rotor 24), as well as options for adjusting crusher settings and/or controlling operation of the crusher 10.

Figure 8:
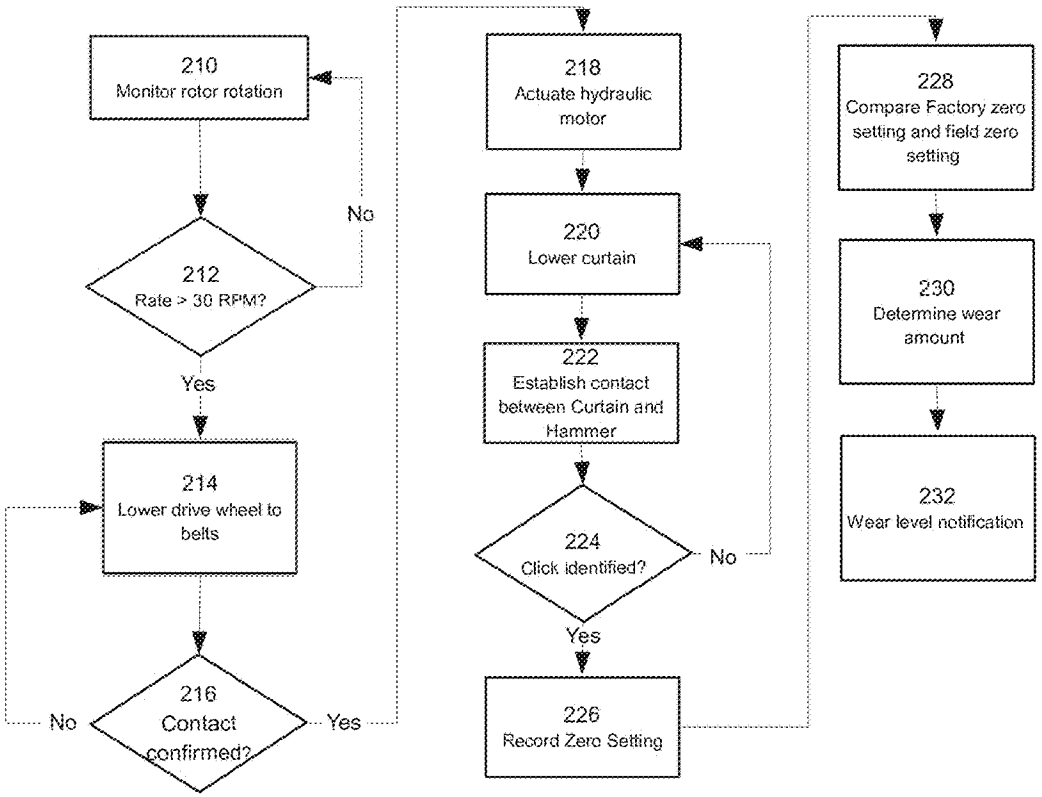
FIG. 8 is a flow chart describing steps for determining a zero setting for an impact crusher, according to an aspect of the invention.
Figure 9:
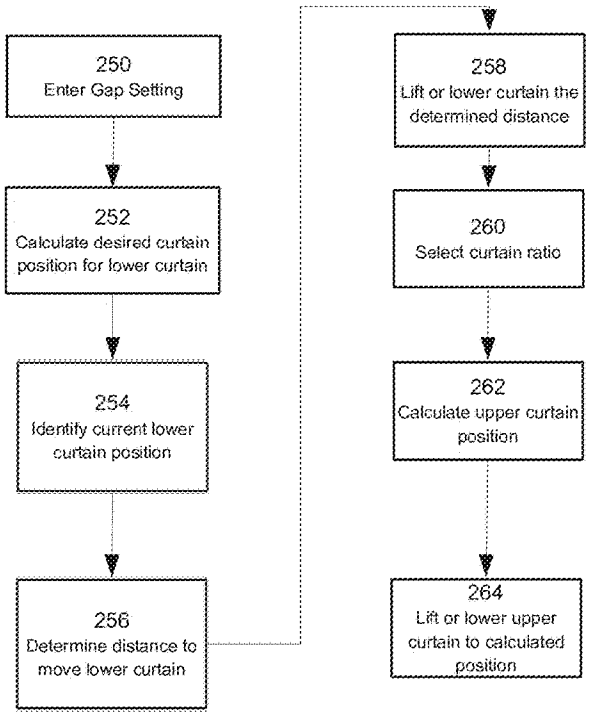
FIG. 9 is a flow chart describing steps for adjusting curtain position for an impact crusher, according to an aspect of the disclosure.

Method of Operation:

With reference to FIGS. 8 and 9, processing routines for operating the crusher 10, in accordance with the present disclosure, are discussed in detail. The processing routines can be performed manually by a system operator. For example, the system operator can direct movement of crusher components using the touch screen display or other data entry components in communication with the crusher 10 (shown in FIGS. 1-6) and/or controller 110 (shown in FIG. 7). Alternatively, the processes discussed herein can be performed automatically. In that case, the system operator can begin a process by, for example, selecting the process from a list of operations on the user interface. The system can be configured to automatically perform the selected process without further control or input by the system operator.

Determining Zero Position:

Zero position or zero setting refers to the position of the curtain when the lower edge of a curtain slightly contacts the hammer circle H or swept area. In the following example, routines for determining the zero position for the lower curtain 32 (shown in FIG. 2) are discussed. However, it is understood that the zero position for other curtains, such as the upper curtain 30 (shown in FIG. 2), can also be determined in a similar manner. Further, it is noted that the curtain position for a desired gap setting can be calculated from a known zero setting. The impact crusher 10 (shown in FIGS. 1-6) can have two different zero settings, referred to herein as a factory zero setting and a field zero setting. The factory zero setting is the zero setting for a crusher 10 having newly installed or replaced hammers and wear plates, which have not been subjected to wear from crushing activities. The field zero setting refers to the zero setting for the crusher 10 after the hammers and/or wear plates are in use and have been subjected to impact forces from feed material being driven through the crusher. The field zero setting changes as the crusher is in use, meaning that it must be re-set or recalibrated during the life cycle of the hammers and/or wear plates. In some examples, the system can be configured to track the change or degradation of the field zero setting to assess or monitor a wear status of the hammers and wear plates. More specifically, differences between the factory zero setting and the field zero setting indicate the accumulated degree or amount of wear to the hammer and/or wear plate. The wear information can be used to develop or update maintenance schedules and to better plan for crusher downtime when the hammers and/or wear plates must be flipped or replaced.

With specific reference to FIG. 8, steps for identifying one of the factory zero setting and the field zero setting are illustrated. Initially, to determine the zero setting, as shown at box 210, the rotor rotation rate is monitored and, at box 212, it is determined when the rotation rate drops below a threshold value, such as 30 rpm. Once the rotor rotation rate drops below the threshold rate, as shown at box 214, the hydraulic cylinder can be extended causing the drive wheel to transition to its engaged position against the belt and/or flywheel. A signal from the pressure sensor can be analyzed to confirm when sufficient contact between the wheel and belt and/or flywheel is established, as shown at box 216.

Once a signal from the pressure sensor indicates that sufficient contact (e.g., pressure) between the wheel and belt is confirmed, the hydraulic motor can be actuated to rotate the rotor at a low rotation rate, as shown at 218. As the low-rotation drive mechanism advances the rotor, one or more of the curtains are advanced toward the hammer circle or swept area in the manner discussed above. For example, as shown at box 220, the curtain can be lowered toward the hammer circle by extending one or more of the hydraulic cylinders. The curtain is slowly lowered until light contact between the curtain and hammers is established, as shown at box 222. The light contact produces a click sound, which can be heard by a system operator and/or identified by a sensor, as shown at box 224. For a rotor having three hammers and rotating at 20 rpm, a click or tick will be heard every second (e.g., 60 clicks per minute). As shown at box 226, the system operator can manually record the zero setting by, for example, pressing a button when he or she first hears the click. Alternatively or in addition, the system can include sensors, such as a microphone or contact sensor, for automatically identifying the click and for recording the zero setting when the click is identified. In other examples, a signal received from the absolute position sensors associated with the hydraulic cylinders can be monitored to identify small changes in cylinder position, which indicate contact between the rotor and curtain. Similarly, a pressure sensor associated with the hydraulic cylinder can be used to determine changes in pressure exerted on the cylinder by the curtains, which indicate contact between the curtain and rotor. In any case, the absolute position of the cylinder (e.g., the hydraulic cylinder extension) when contact is identified, is recorded as the zero setting or zero position.

If the hammers and wear plates for the crusher are new, then the zero setting recorded at 226 is the factory zero setting. If the hammers and wear plates have already been used, then the zero setting recorded at 226 is the field zero setting. In that case the recorded field zero setting can be compared to a previously determined factory zero setting as shown at box 228. Based on the results of the comparison, a wear amount or wear level for the hammers and/or wear plates can be determined as shown at 230. As shown at box 232, when the wear level or degree reaches a predetermined threshold value, the system can provide a notification to the system operator that the hammers and/or wear plates should be replaced. Additionally, the system can be configured to monitor accumulation of wear by the hammers to predict or estimate when the hammers should be replaced. In that case, the system can provide a notification to the system operator before the wear level or degree reaches the threshold value, so that the system operator can anticipate and/or plan for replacement of the hammers and/or wear components.

Once the zero setting and wear level are determined, the crusher can be ready for use. In that case, as discussed in detail below, the hydraulic cylinders can be activated to position the curtains at a desired gap setting, which can be determined based on the zero setting.

Curtain Adjustment:

With reference to FIG. 9, steps for adjusting operating settings for the crusher 10 are illustrated. As shown at box 250, the system operator enters or selects one or more crusher settings, such as a desired gap setting, nominal material size (e.g., about 80% of material expelled from the crusher is below a particular size), or an average crushed material diameter. As shown at box 252, the system calculates a curtain position for the lower curtain and, in some cases, the upper curtain to produce the selected gap settings based, at least in part, on the factory zero setting and/or the field zero setting determined as discussed above in connection with FIG. 8. The system also determines the current position of the curtain, as shown at 254, and calculates an amount that the hydraulic cylinder that supports the curtain must extend or retract to place the curtain at the calculated position, as shown at 256. The current curtain position can be determined based on signals received from the absolute position sensor associated with the hydraulic cylinders. Once the amount that the cylinder must extend or retract is determined, as shown at box 258, the lower curtain is moved to the desired position by extending or retracting the hydraulic cylinder the calculated amount.

Once the lower curtain is moved into position, the system can be configured to automatically position the upper curtain based on a predetermined ratio between the gap setting for the upper curtain and the lower curtains. For example, as shown at box 260, a curtain ratio can be selected. In some examples, the ratio is about 2:1 or 3:1 (e.g, the gap setting for the upper curtain is 2 or 3 times greater than the gap setting for the lower curtain). In order to automatically determine the upper curtain position, the system calculates the desired gap setting for the upper curtain based on the predetermined or selected ratio and, based on the calculated gap setting, calculates a distance that the hydraulic cylinder for the upper curtain must be extended or retracted to reposition the upper curtain to the selected gap setting, as shown at box 262. As shown at box 264, the upper curtain is moved to the calculated position.

In some examples, the system can also be configured to permit the system operator to manually select a position or gap setting for the upper curtain and, based on the selected position or gap setting, calculate a position for the lower curtain. For example, the system operator can manually adjust the position of the upper curtain using control buttons located on the user interface. The system can be configured to determine a desired position for the lower curtain to satisfy the predetermined ratio. The system can then be configured to cause the hydraulic cylinder for the lower curtain to extend or retract to lift or lower the curtain to the desired position. In other examples, the system can be configured to adjust the gap setting for each of the one or more curtains independently. For example, the system operator can enter a gap setting for the lower curtain and a gap setting for the upper curtain. The system can be configured to actuate the hydraulic cylinders to advance the curtains to the selected gap settings in the manner discussed above.

Exemplary User Interface:

With reference to FIGS. 10A-10G, exemplary user interfaces that can be displayed to the system operator on the display device, such as visual display 118 (shown schematically in FIG. 7) or another visual display are illustrated. The user interfaces can be controlled, for example, by the user interface module 116 (shown in FIG. 7). The user interfaces allow the user to perform numerous activities for calibrating and operating the crusher, including, for example, determining the factory or field zero settings, monitoring wear of the hammers and/or wear plates, and adjusting the curtain position to a desired gap setting.

Further, it is appreciated that the screens and screen sequences described below are for illustration only and should not be construed as being the only way to implement the concepts described herein. For example, in the context of adjusting the curtain position, the sequence of screens or the screens themselves can be changed from those shown in FIGS. 10A-10G to include other screen sequences or screens related to crusher setup and/or operation without departing from the spirit of the concepts described herein.

Figure 10B:
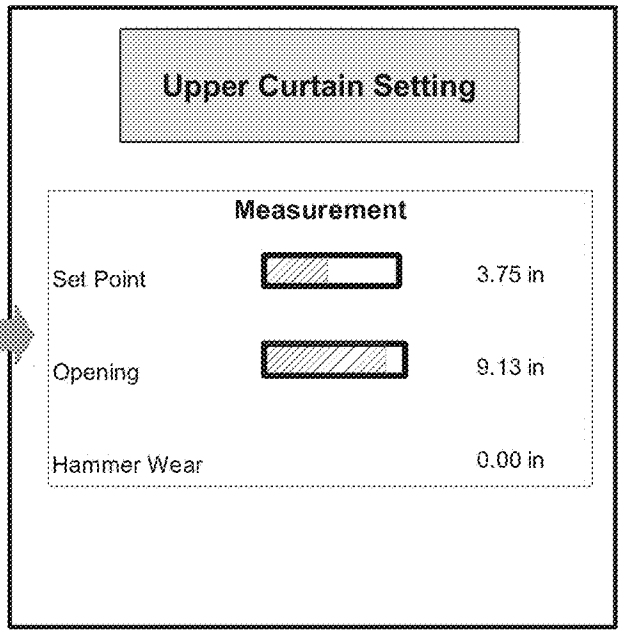
FIGS. 10A-10G are exemplary user interface screens for controlling the system of FIG. 7.
Figure 10A:
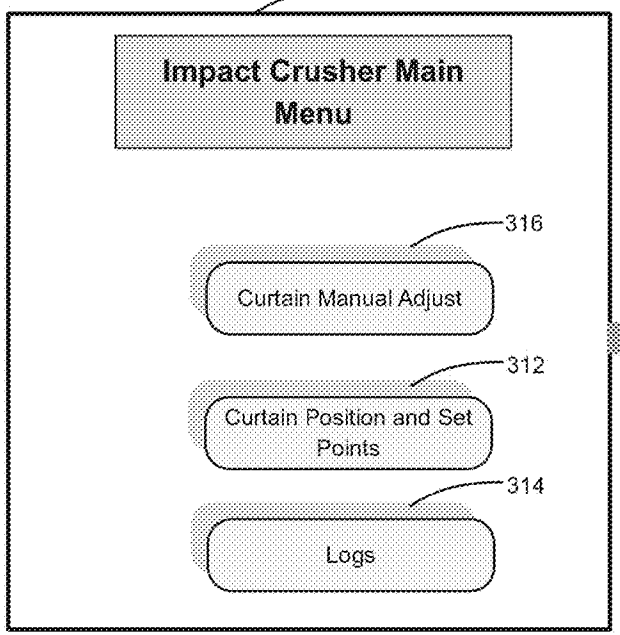

With reference to FIG. 10A, a main menu or home screen 310 is provided. The home screen includes a position information button 312 that, when selected, provides the system operator with information about the position of the curtains, extension of the hydraulic cylinders, and gap settings for the crusher 10. An exemplary position information screen 314 is illustrated in FIG. 10B. In some examples, the position information can also include wear information, such as an amount of wear for the hammers and/or wear plates and/or an estimated use time until the hammers and/or wear plates should be replaced. In some examples, the wear level can be provided, for example, as the difference between the factory zero setting and field zero setting for the crusher presented either as an absolute distance or a percentage. The greater the difference between the factory zero setting and the field zero setting, the greater the wear for the hammers and/or wear plates.

With reference again to FIG. 10A, the home screen 310 can also include a curtain manual adjust button 316 that, when selected, provides the system operator with a series of screens for manually adjusting the curtain position. The home screen 310 can also include an automatic curtain adjust screen that, when selected, begins a process for automatically adjusting the curtain position to a selected gap setting, according to the process described above.

Figure 10C:
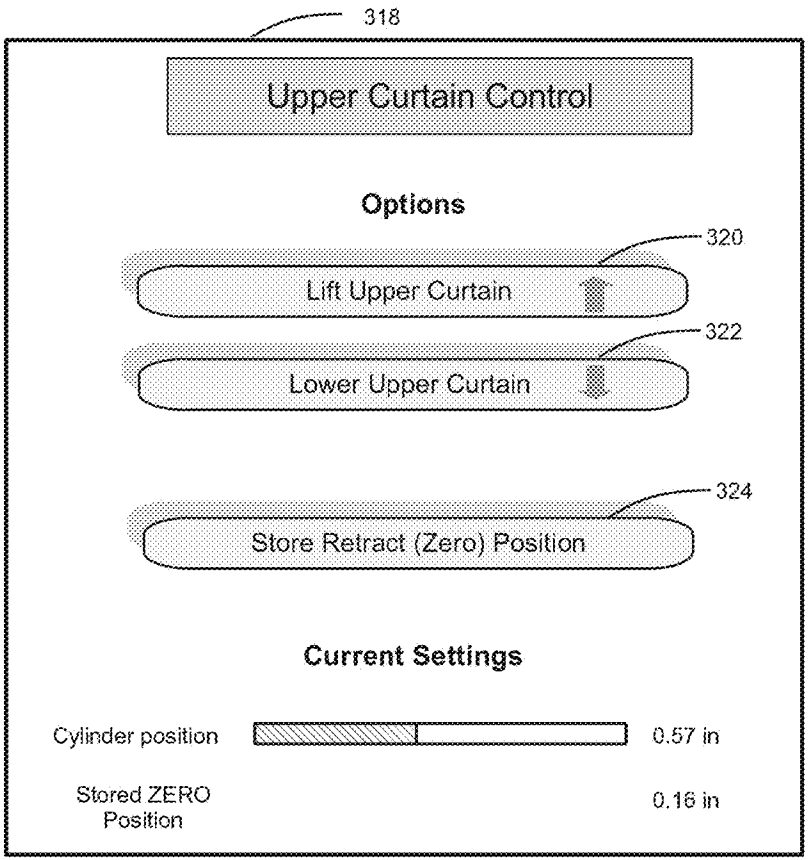

With reference to FIG. 10C, an exemplary curtain control screen 318 is illustrated. The curtain control screen 318 illustrated in FIG. 10C is used for adjusting the position of the primary or upper curtain. A similar screen can also be provided for adjusting the position of the secondary or lower curtain. The screen 318 can include a lift curtain button 320 which, when selected, causes the controller to execute a process for lifting the curtain, such as, for example, causing the cylinder piston to extend, thereby lifting or raising the curtain. The screen 318 can also include a curtain lower button 322 that, when selected, causes the controller to execute a process to lower the curtain. For example, the process for lowering the curtain can include causing the hydraulic cylinder to retract to adjust the position of the curtain. In some examples, the user interface can be configured such that the curtain continues to lift or lower as long as the system operator continues to press the appropriate button 320, 322. In other examples, upon pressing and releasing the button 320, 322, the controller can be configured to raise or lower the curtain a predetermined amount. The system operator can cause the curtain to raise or lower an additional amount by pressing the button 320, 322 a second time.

The screen 318 can also include a button 324 for storing the zero position for the curtain. As described above, the zero position can be manually identified when a click or tick sound is created by contact between the curtain and hammers. When the system operator hears the click he or she can select the button 324 to store the zero position for the system. The screen 318 can also include a visual indicator 326 showing the actual real-time cylinder position for the hydraulic cylinder. For example, the visual indicator 326 can be a gas gauge style indicator illustrating the actual cylinder position in relation to a maximum and minimum cylinder position. The screen 318 can also display the actual cylinder position (in inches or centimeters). In other examples, the screen 318 can also include a button for storing the maximum lift position for the curtain (e.g., the position of the curtain when the cylinder is completely extended). The maximum lift position only needs to be determined when either the cylinder sensor or entire hydraulic cylinder has been replaced.

Figures 10D, 10E:
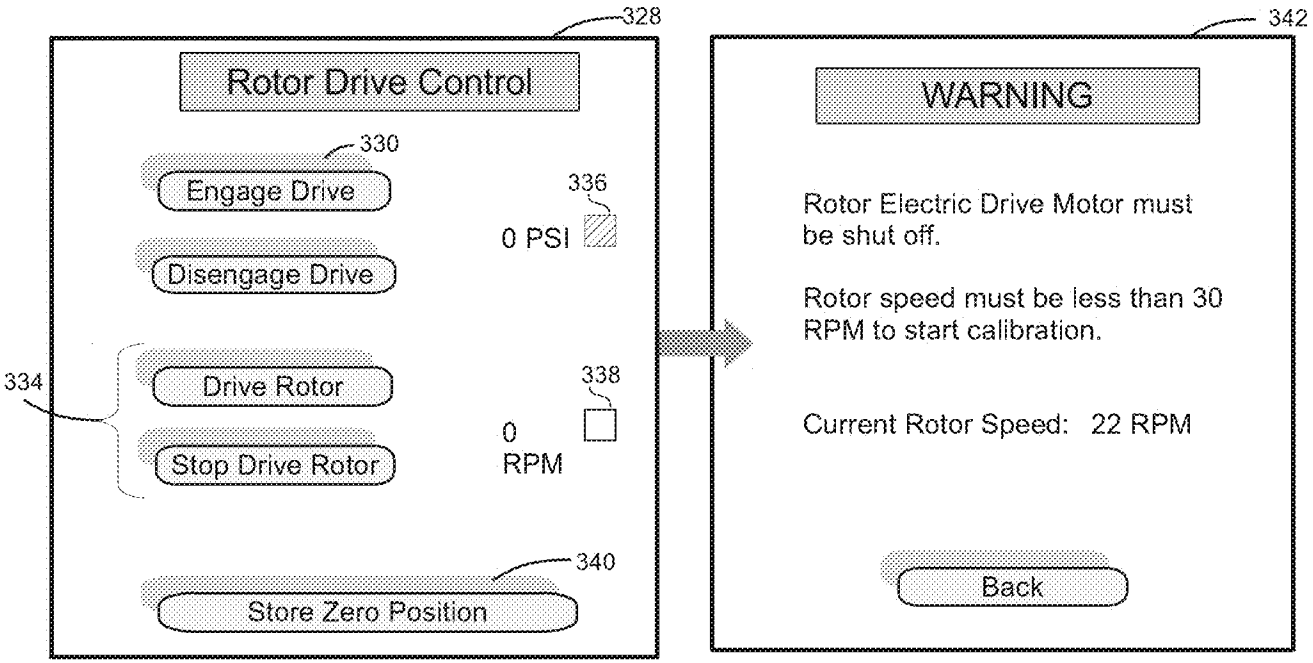

With reference to FIG. 10D, a screen 328 for controlling the low-rotation drive mechanism is illustrated. The screen 328 includes buttons 330, 332 for causing the drive wheel 70 (shown in FIGS. 1, 5, and 6) to engage and disengage from the belts 26. By selecting the engage drive button 330, the engagement cylinder 78 (shown in FIGS. 1, 5, and 6) is actuated causing the drive wheel 70 to come into contact with the belts 26. Selecting the disengage drive button 332 causes the hydraulic cylinder to move the drive wheel 70 away from the belt 26. The screen 328 can also display the pressure (in pounds per square inch) measured by the sensor associated with the hydraulic cylinder. The system operator can determine when good contact between the drive wheel 70 and v-belt 26 is established based on the displayed pressure sensor measurement.

The screen 328 can also include buttons 334 for actuating and turning off the hydraulic motor for driving the drive wheel. Once good contact between the wheel and belt is created, as shown by pressure information received from the pressure sensor, the system operator can select the button 334 to actuate the motor causing the motor to drive the wheel. The screen 328 can also display the rotation rate (in rotations per minute) for the flywheel and rotor of the crusher. The rotation rate can be measured by sensors associated with the flywheel and/or rotor. As discussed above, it is recommended that the wheel should not be engaged to the belt unless the rotor rotation rate is below 30 rpm. Accordingly, a system operator can be instructed not to select the engage drive button 330 until the rotation rate drops to an acceptable value. Similarly, the system can be configured to prevent the wheel from engaging the belt until the rotation rate of the rotor decreases to an acceptable value. In other examples, the process of actuating and turning off the drive wheel motor can occur automatically. For example, the user may press a button or other mechanism to begin the motor actuation process. In response to the button press, the system can monitor the rotor rotation rate, cause the wheel to engage the belts once the rotation rate drops below a threshold value, and, once good contact between the wheel and belt is established, automatically actuate the motor.

In some examples, as shown in FIG. 10D, the screen 328 can also include visual indicators 336, 338 for informing the system operator of one or more of the following: (1) that the pressure measured by the sensor associated with the hydraulic cylinder shows that there is sufficient contact between the wheel and belt; and (2) that the rotor rotation rate is low enough to begin operation of the motor. For example, the visual indicators 336, 338 can be colored squares that appear green when the measured value is within the acceptable range and red when the value measured by the sensor is not within the acceptable range. The screen 328 can also include a button 340 for storing the zero position. As discussed above, when the system operator hears the clicking sound indicating that the curtain is just contacting the hammers, he or she can select the button 340 to store the calibration or zero position.

With reference to FIG. 10E, the user interface can also include a warning screen 342 that includes a warning to be issued if the system operator attempts to actuate the drive motor of the low-rotation rate drive mechanism when the rotor rotation rate exceeds about 25 or 30 rpm. As discussed above, the motor should only be actuated when the rotor rotates at low speeds of less than 25 rpm or 30 rpm. The screen 342 can include an information section informing the system operator that the rotor speed is too high and that the electric drive motor is automatically turned off. The screen 342 can also display the current rotor rotation rate, as measured by a sensor associated with the flywheel or rotor, so that the system operator can determine how fast the rotor is currently rotating and about how much time is required for the rotor to slow down to an acceptable rotation rate for performing the zero setting calibration process.

Figure 10F:
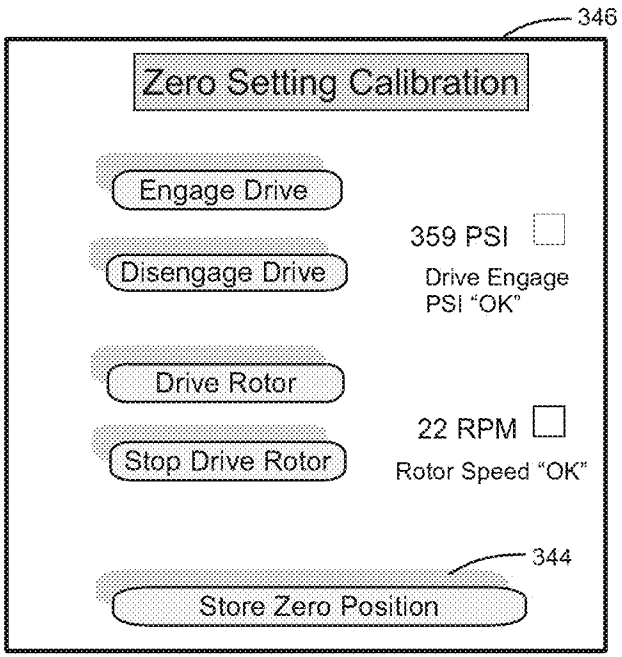

With reference to FIG. 10F, a screen 346 for determining the zero setting is illustrated. The screen 346 is substantially similar to the curtain control screen illustrated in FIG. 10C. As described in connection with FIG. 10C, to determine the zero setting, the system operator lowers the curtain until the clicking sound can be heard. When the clicking sound is heard, the system operator selects a Store Zero Setting button 344 to store the cylinder position information for the zero setting. In some examples, once the button 344 is selected by the system operator, the controller is configured to cause the curtain to lift away from the hammer circle or swept area, the electronic drive motor to stop rotating the wheel, and the wheel to disengage from the belts. Alternatively, the system operator can manually perform these functions using the user interface screens described hereinabove. The user interface can also include a screen for determining or selecting the field zero setting, which is substantially similar to the screen shown in FIG. 10F. As discussed above, the field zero setting is determined once the hammers are in use and is indicative of the amount of wear on the hammers and/or wear plates of the curtains.

Figure 10G:
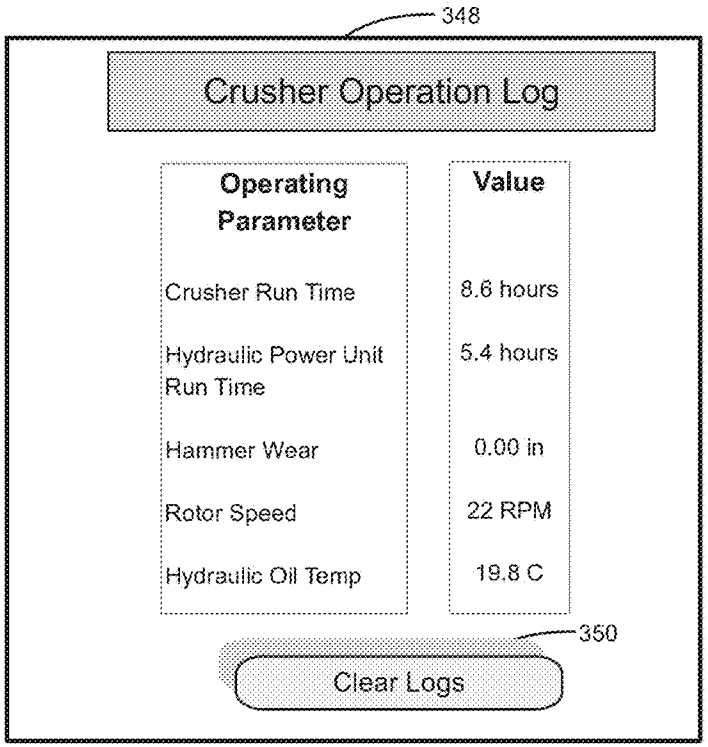

With reference to FIG. 10G, the user interface can also include one or more log screens 348 for displaying data collected during operation of the crusher. The log screen 348 can be accessed from a menu or home screen, such as the home screen 310 shown in FIG. 10A. The log screen 348 can display numerical values for the operating parameters of the crusher that are of interest to the system operator. In some examples, the log screen 348 can also include visual indicators, such as gas gauge icons, graphs, and other visual representations of crusher operating parameters. Exemplary operating parameters and/or settings that can be displayed on the log screen 348 include, but are not limited to, Crusher run time, Hydraulic power unit run time, Hammer wear, Rotor speed, Hydraulic oil temperature, and others. The log screen 348 can also include a Clear Logs button 350 that allows the system operator to erase any previous measurements and to begin collecting new data concerning operation of the crusher.

Figure 11:
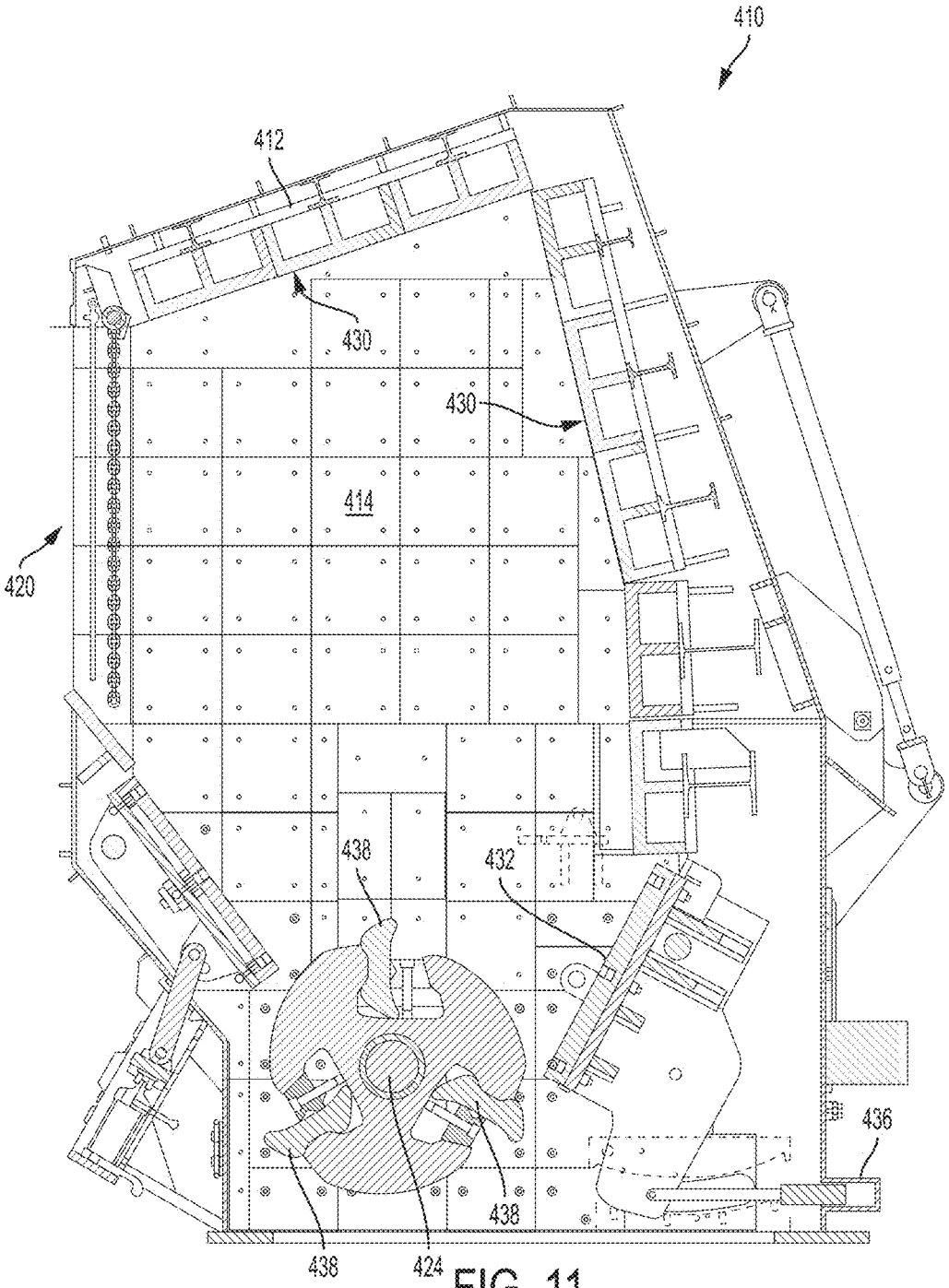
FIG. 11 is a cross section view of another example of an impact crusher with a curtain adjustment mechanism according to an aspect of the disclosure.

New Holland-Style Crusher:

As discussed above, the adjustment system described in this application can be adapted for use in other types of crushers such as, for example, a New Holland-style crusher and a Hammer Mill-style crusher. With reference to FIG. 11, a cross section view of a New Holland-style crusher 410 adapted for use with the adjustment system discussed herein is illustrated. The New. Holland-style crusher 410 operates in a similar manner to the impact crusher 10 illustrated in FIGS. 1-6, and includes a housing 412 enclosing a crushing chamber 414. The housing 412 is taller and narrower than the housing for the impact crusher illustrated in FIGS. 1-6. As was the case with the crusher in FIGS. 1-6, feed material enters the chamber 414 through an opening 420. The feed material travels by gravity toward the rotor 424 positioned near the bottom of the crushing chamber 414. Unlike the impact crusher in FIGS. 1-6 that includes adjustable curtains for crushing the feed material, the New-Holland style crusher 410 includes one or more fixed breaker surfaces or walls 430 enclosing an upper portion of the chamber 414. The rotor 424 and hammers 438 extending radially therefrom, drive or direct the feed material toward the fixed breaker surfaces 430, thereby crushing the feed material.

The crusher 410 also includes an adjustable breaker plate 432 positioned near the bottom of the chamber 414. The breaker plate 432 can be pivotally mounted, on one end, to the housing 412 or to an interior wall of the chamber 414. On the other end, the breaker plate 432 can be held in place by a hydraulic cylinder 436, such as the Intellinder™ described above. Adjusting the cylinder 436 position (e.g., extending or retracting the cylinder) adjusts the gap setting for the crusher 410. The farther the cylinder 436 is extended, the smaller the gap setting and the smaller the diameter of the crushed material being expelled from the crusher 410. As was the case with the crusher discussed in FIGS. 1-6, once the material is crushed to a diameter small enough to pass through the gap setting, the crusher material is expelled from the crusher 410 through a lower discharge outlet 422. The cylinder 436 and breaker plate 432 can be operated in a similar manner to the curtain adjustment mechanism discussed herein above. For example, the breaker plate 432 can be manually lowered until a distinctive click is heard to determine a zero setting for the crusher 410. In addition, the hydraulic cylinder 436 can be used to adjust the gap setting for the crusher 410 while the crusher 410 is in use and without stopping the rotor 424. Finally, it is noted that the crusher 410 shown in FIG. 11 can be modified to include the low-rotation drive mechanism 28 illustrated, for example, in FIGS. 1, 5, and 6 of the present application. The low-rotation drive mechanism 28 can be used to slowly advance the rotor 24 when determining the zero setting for the crusher 410.

The principles discussed herein in connection with the New Holland style crusher 410 can also be implemented for a Hammer-Mill style crusher. A Hammer Mill-style crusher includes an adjustable breaker plate that can be mounted to a hydraulic cylinder in the same manner as the breaker plate 432 and hydraulic cylinder 436 discussed above. Further, the hydraulic cylinder 436 can be adjusted automatically using the adjustment system disclosed in this application to, for example, automatically determine a zero setting or to adjust the position of the breaker plate 432 while the rotor is in motion.

While specific examples of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof. Further, although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An impact crusher for crushing a feed material received through an opening of the crusher, the crusher comprising:

a housing defining a crushing chamber;

at least one impact barrier mounted in the crushing chamber;

a barrier adjustment mechanism configured to adjust an elevation of the at least one impact barrier within the crushing chamber;

a rotor mounted in the crushing chamber configured to direct feed material toward the at least one impact barrier;

a drive mechanism comprising a flywheel configured to turn the rotor, a belt connected to the wheel, and a main motor mechanically coupled to the wheel via the belt; and an auxiliary drive configured to selectively engage the belt to turn the wheel at a low rotation rate when the main motor is turned off, wherein the barrier adjustment mechanism comprises at least one hydraulic cylinder mounted directly or indirectly to the at least one impact barrier, a piston comprising an end contacting the housing configured to extend from and retract into the at least one hydraulic cylinder to adjust the elevation of the impact barrier relative to the housing and to the rotor, and a sensor for detecting an absolute extension of the piston relative to the at least one hydraulic cylinder during operation of the impact crusher.

2. The impact crusher of claim 1, wherein a shortest distance between the rotor and an impact surface of the at least one impact barrier defines a gap setting of the impact crusher, and wherein adjustment of the elevation of the at least one impact barrier increases or decreases the gap setting.

3. The impact crusher of claim 1, wherein the drive mechanism is configured to turn the rotor at a rotation rate of at least 400 rpm.

4. The impact crusher of claim 1, wherein the piston comprises a plurality of graduated markings on an outer surface thereon, and wherein the sensor is configured to detect the plurality of graduated markings to identify the absolute extension of the piston relative to the at least one hydraulic cylinder.

5. The impact crusher of claim 4, wherein the sensor comprises an optical sensor.

6. The impact crusher of claim 1, wherein the at least one impact barrier comprises a first impact barrier and a second impact barrier, wherein the at least one hydraulic cylinder comprises a first hydraulic cylinder and a second hydraulic cylinder, and wherein the elevation of the first impact barrier and the second impact barrier are independently controlled by the first hydraulic cylinder and the second hydraulic cylinder, respectively.

7. The impact crusher of claim 1, wherein the at least one hydraulic cylinder floats relative to the housing of the impact crusher, such that the elevation of the at least one impact barrier is movable without adjustment of the extension of the at least one hydraulic cylinder.

8. The impact crusher of claim 7, wherein the barrier adjustment mechanism further comprises a mechanical stop mechanism configured to block the at least one impact barrier from being lowered below a predetermined minimum elevation.

9. The impact crusher of claim 1, wherein the barrier adjustment mechanism further comprises at least one shock absorber mounted between the at least one hydraulic cylinder and the housing, the shock absorber being configured to at least partially absorb impact forces caused when the at least one impact barrier returns to a pre-set position.

10. The impact crusher of claim 1, wherein the auxiliary drive comprises an auxiliary drive wheel configured to engage the belt of the drive mechanism by a friction engagement to advance the belt and the flywheel connected thereto.

11. The impact crusher of claim 10, wherein the auxiliary drive wheel is mounted to an elevation adjustable lever mounted to a mechanical actuator, and wherein adjustment of extension of the mechanical actuator causes the auxiliary drive wheel to engage or disengage from the belt.

12. The impact crusher of claim 11, wherein the mechanical actuator of the auxiliary drive comprises at least one sensor for determining an amount of pressure exerted between the belt and the flywheel.

13. A system for crushing a crushable material comprising:

an impact crusher comprising:

a housing defining a crushing chamber;

at least one impact barrier mounted in the crushing chamber;

a barrier adjustment mechanism configured to adjust an elevation of the at least one impact barrier within the crushing chamber;

a rotor mounted in the crushing chamber configured to direct feed material toward the at least one impact barrier;

a drive mechanism comprising a flywheel configured to turn the rotor, a belt connected to the wheel, and a main motor mechanically coupled to the wheel via the belt; and an auxiliary drive configured to selectively engage the belt to turn the flywheel at a low rotation rate when the main motor is turned off, wherein the barrier adjustment mechanism comprises at least one hydraulic cylinder mounted directly or indirectly to the at least one impact barrier, a piston comprising an end contacting the housing configured to extend from and retract into the at least one hydraulic cylinder to adjust the elevation of the impact barrier relative to the housing and to the rotor, and a sensor for detecting an absolute extension amount for the piston relative to the at least one hydraulic cylinder during operation of the impact crusher; and a controller electrically connected to the at least one hydraulic cylinder and to the drive mechanism, the controller being configured to:

determine a zero setting of the impact crusher, comprising the absolute extension amount for the piston relative to the at least one hydraulic cylinder when the at least one impact barrier contacts the rotor;

receive a gap setting for the impact crusher;

calculate, based on the zero setting and the gap setting, a piston position required for the at least one hydraulic cylinder to achieve the gap setting; and one of extend and retract the piston of the at least one hydraulic cylinder to the calculated piston position based on information from the sensor of the at least one hydraulic cylinder.

14. The system of claim 13, wherein the auxiliary drive comprises an auxiliary drive wheel configured to engage the belt of the drive mechanism by a friction engagement to advance the belt and the flywheel connected thereto.

15. The system of claim 14, wherein in order to determine the zero setting, the controller is configured to:

cause the auxiliary drive wheel to move towards and engage the belt to rotate the flywheel and the rotor at the low rotation rate;

actuate the at least one hydraulic cylinder thereby causing the at least one impact barrier to be lowered toward the rotor; and identify an extension position of the piston relative to the at least one hydraulic cylinder when contact between the at least one impact barrier and the rotor occurs.

16. The system of claim 15, further comprising an audio sensor electrically connected to the controller and associated with the rotor, and wherein, in order to identify the contact between the rotor and impact barrier, the controller is configured to identify, with the audio sensor, a sound representative of contact between the impact barrier and the rotor.

17. The system of claim 13, wherein the at least one impact barrier comprises a first impact barrier and a second impact barrier in the crushing chamber, and wherein the controller is further configured to cause the barrier adjustment mechanism to adjust an elevation of the second impact barrier based on a selected or predetermined ratio between a selected gap setting for the first impact barrier and a gap setting for the second impact barrier.

18. The system of claim 13, wherein the controller is further configured to determine a wear level of one of the rotor and/or the at least one impact barrier, the wear level being determined based on a difference between a factory zero setting and the determined zero setting.

* * * * *